US007850214B2

(12) United States Patent
Ambriiz

(10) Patent No.: US 7,850,214 B2
(45) Date of Patent: Dec. 14, 2010

(54) CLOSURE SAFETY INTERLOCK FOR A PRESSURE VESSEL

(75) Inventor: Steven Richard Ambriiz, Missouri City, TX (US)

(73) Assignee: Axxiom Manufacturing, Inc., Fresno, TX (US)

( * ) Notice: Subject to any disclaimer, the term of this patent is extended or adjusted under 35 U.S.C. 154(b) by 503 days.

(21) Appl. No.: 11/705,392

(22) Filed: Feb. 12, 2007

(65) Prior Publication Data

US 2008/0190925 A1 Aug. 14, 2008

(51) Int. Cl.
*B65D 45/00* (2006.01)
*B65D 45/32* (2006.01)

(52) U.S. Cl. ..... 292/256; 292/256.5; 292/256.71; 292/256.73

(58) Field of Classification Search ..... 292/256, 292/256.5, 256.71, 256.73
See application file for complete search history.

(56) References Cited

U.S. PATENT DOCUMENTS 1,510,330 A * 9/1924 Nechroni ..... 114/178
1,519,767 A * 12/1924 Demuth ..... 220/324
1,685,132 A * 9/1928 Joy ..... 220/327
1,978,607 A * 10/1934 Straty ..... 220/325
2,134,314 A * 10/1938 O'Donnell ..... 292/115
2,288,312 A * 6/1942 Brown ..... 220/203.1
4,073,239 A * 2/1978 Adler ..... 105/377.11
4,519,519 A * 5/1985 Meuschke et al. ..... 220/211
4,678,620 A * 7/1987 Marshall et al. ..... 376/203
6,095,365 A * 8/2000 Yielding ..... 220/264
6,439,415 B1 * 8/2002 Salim et al. ..... 220/323
6,454,117 B1 * 9/2002 Pysher et al. ..... 220/327
6,595,716 B1 * 7/2003 VanDeVyvere et al. ..... 404/26
7,427,089 B2 * 9/2008 Silverio et al. ..... 292/256.5

* cited by examiner

*Primary Examiner*—Carlos Lugo
(74) *Attorney, Agent, or Firm*—Robert C. Curfiss

(57) ABSTRACT

A closure safety interlock system is provided for a pressure vessel having a closure assembly with a primary locking system. The closure safety interlock defines a secondary locking system for assuring that the primary locking system may be opened only by following a proper sequence, thereby minimizing misuse of the primary locking system. The closure safety interlock includes a blocking member movable between an engaged position and a disengaged position for blocking movement of a primary lock when in the engaged position and until a release mechanism in the primary lock has been activated. A mechanism is provided for moving the blocking member from the engaged position to the disengaged position once the release mechanism has been activated.

2 Claims, 8 Drawing Sheets

CLOSURE SAFETY INTERLOCK FOR A PRESSURE VESSEL

BACKGROUND OF THE INVENTION

1. Field of the Invention

The present invention is related to media pressure vessels for bulk abrasive blaster systems and is specifically directed to the closure assembly for such vessels.

2. Description of the Prior Art

The function of a bulk abrasive blaster system is to provide a controlled mixture of dry abrasive or non-abrasive media and compressed air to a blast nozzle. The abrasive blast stream may be used to prepare the surface being blasted for the application of a protective coating or may be used for simple removal of unwanted surface defects, or other typical blasting operations. The bulk abrasive blaster is one of the components of the abrasive blasting system. The system typically comprises an air compressor, a moisture removal device, the bulk abrasive blaster, a blast line and a blast nozzle.

In the most typical applications, the bulk abrasive blaster comprises a pressure tank or pressure vessel with a top closure assembly adapted to be placed in communication with the outlet of an abrasive storage hopper for filling the tank when the abrasive or media therein is depleted. A pressure system is utilized for pressuring the tank when it contains an operable amount of abrasive. Once the tank is pressurized, the abrasive or media flows through an outlet and into a blast line where it is propelled through the blast nozzle.

When the system is shut down, or in blowdown condition, the pressure valve is closed and a blowdown valve is opened to relieve the pressure in the vessel and permit it to achieve ambient pressure levels.

It is important in the operation of the system that the tank closure assembly not be opened at any time when the pressure tank is at a pressure higher than the ambient external pressure. This is particularly important when the system is operated in such a manner the bulk abrasive blaster system, including the pressure tank, is maintained in a pressurized state when in an off condition. However, caution must be taken at all times to make certain the vessel is at ambient external pressure before the closure assembly is opened for any reason.

In normal depressurizing operation, the air inlet valve on the tank is closed. The blowdown valve on the tank is then opened to relieve the pressure in the tank. Once airflow from the blowdown valve stops and the tank is depressurized, the closure assembly may be opened. Typically a pressure indication valve is provided near the closure assembly to provide a check point for confirming that the vessel is at ambient pressure before opening the closure assembly.

Prior art closure assemblies are designed to minimize the ability to open the tank when it is pressurized. These typically include a closure hub installed on an opening in the top of the tank and a closure head for opening and closing the opening in the hub and the tank.

The hub is generally cylindrical and is welded on the vessel. A hinged closure head is designed to fit on the closure hub for opening and closing the vessel. One or more swing bolts are mounted on the hub and designed to swing into and out of engagement with a holding lug on the closure head. Locking nuts are placed on the outer end of the bolts and are tightened down against the holding lugs for locking the closure head against the closure hub. Typically, the bolts are mounted in a cam lock assembly wherein the swing bolts and nuts, once assembled, may be tightened against the holding lug by swinging a camlock handle from an opened position to a closed, locked position, for generating tension in the swing bolts.

When the tank is pressurized, the closure head will attempt to move up and away from the closure hub, increasing the tension on the bolts. When the tank is depressurized, the closure head will move into its fully seated position, reducing the tension on the bolts. In proper application, the camlock handle may not be moved from the locked to the open position when the tank is pressurized, but is easy to swing from the locked to the open position when the tank is depressurized.

This type of closure assembly serves as an access port that can be opened without the use of tools. The safe use of the closure requires that the pressure vessel first be completely free of internal air pressure prior to opening the closure. A hazardous situation occurs when the operator fails to vent the air pressure prior to attempting to open the closure. The compressed air inside the tank can contain a dangerously high level of energy which can propel objects. This air pressure will also cause the failure of the closure assembly if some of the swing bolts are moved into the open position with the presence of air pressure within the pressure tank or pressure vessel.

The camlock assembly is a first level safety feature that alerts the operator of the presence of air pressure within the tank by allowing air to leak from the closure assembly provided that the closure is opened in the proper sequence. The proper sequence requires that all camlock handles be swung into the open position prior to moving any of the swing bolts, thereby reducing the tension on the swing bolts. This allows the closure head to slightly rise and leak air pressure, thereby alerting the operator to the presence of air pressure.

During the incorrect opening sequence the operator can swing one camlock handle and then proceed in moving the swing bolt out of the holding lug. And then proceed to open the next camlock assembly in this incorrect method. If there is air pressure present the closure head will not raise to alert the operator since the remaining swing bolt will hold the closure head down. If the operator proceeds in incorrectly opening the camlock assemblies the stress induced on the remaining swing bolts by the air pressure on the closure head can cause the failure of these swing bolts.

Depending on the conditions and sequence, the swing bolt may not easily move from the holding nut due to the air pressure within the tank. The operator may not recognize this as an indication of the presence of air pressure and then proceed to improperly use a hammer or other such device to aid in knocking out the swing bolt from the holding nut which will result in failure in the event that air pressure is in fact within the pressure tank.

While this system is very effective when used properly, it is desirable to provide a secondary safety interlock that will require proper sequence of opening.

SUMMARY OF THE INVENTION

The subject invention is directed to a secondary closure safety interlock system for use in combination with the closure assembly of a pressure vessel or tank and is particularly useful in bulk abrasive blaster system wherein the pressure tank includes not only pressurized fluid such as air, but also particulate abrasives or media.

In the broadest sense, the closure safety interlock system of the present inventions is adapted for a pressure vessel having a closure assembly with a primary locking system. The closure safety interlock defines a secondary locking system for assuring that the primary locking system may be opened only by following a proper sequence, thereby minimizing misuse of the primary locking system. In the preferred embodiment, the closure safety interlock includes a blocking member movable between an engaged position and a disengaged position for blocking movement of a primary lock when in the engaged position and until a release mechanism in the primary lock has been activated. A mechanism is provided for moving the blocking member from the engaged position to the disengaged position once the release mechanism has been activated. In the preferred embodiment the safety interlock also includes sequencing indicia indicating the sequence which should be followed in activating the release mechanism. A limiter device may be provided for limiting the movement of the blocking member from the engaged position to the disengaged position.

In its preferred form the closure safety interlock system includes an interlock shield mounted over the swing nuts and closure head components of the closure assembly. The shield may be moved between a locking position and an open position. When in the locking position, it blocks access to the swing bolts, prohibiting the ability to force the bolts out of the holding lugs until all camlock handles have been rotated to the open position. This assures that the closure head will move as intended if the tank is under pressure or will remain properly seated in the hub if the tank is not under pressure, giving a good visual indication of the condition of the tank before opening the closure head.

In the preferred embodiment of the invention, the closure safety interlock shield includes a plurality of spokes or arms in one-to-one relationship with the swing bolts. The shield is mounted directly on the closure head. The shield is rotatable between a locked position wherein the spokes cover bolts, prohibiting the bolts from swinging out of the holding lugs and an opened position providing unrestricted access to the bolts. A gap exists between each pair of spokes, each gap adapted for accommodating one camlock handle when the handle is in the locked position. This prevents rotation of the shield until all of the camlock handles have been moved to the open position, assuring proper opening sequence of the closure head.

It is desirable to provide limitation of rotation of the shield to assure proper alignment of the shield spokes with the swing bolt assemblies, particularly when the bolts are not equally spaced around the perimeter of the closure head. It is also desirable to provide a positive indicator for determining when the shield is in the open and the locked positions.

The closure safety interlock of the present invention prevents the operator from opening the closure head in an incorrect sequence by blocking the operation of the swing bolts until all of the camlock handles are in the open position. This opening sequence is necessary to maintain the "designed in" alerting feature of the closure which indicates the presence of air pressure within the pressure vessel.

The closure safety interlock also shields the swing bolts and thereby minimizing the operator's ability to use a hammer or other device to aid in moving the swing bolts to the open position when any camlock handle is in the locked position.

DETAILED DESCRIPTION OF THE PREFERRED EMBODIMENTS

Figure 1:
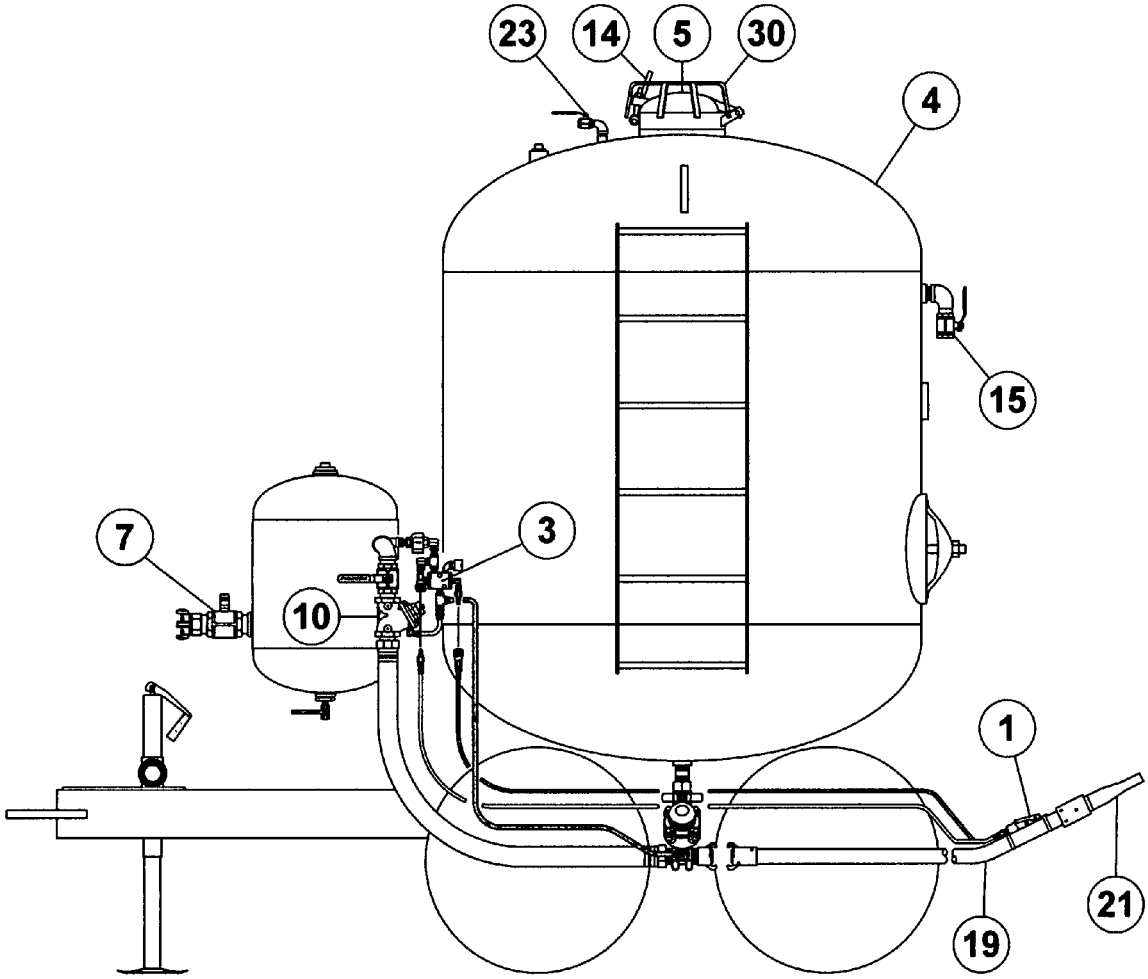
FIG. 1 is a view of a typical bulk abrasive blaster with a pressure vessel or tank having a closure assembly and a closure safety interlock in accordance with the subject invention.

A typical bulk abrasive blaster is shown in FIG. 1 The pressure tank of pressure vessel 4 includes a pressure inlet valve 7 which is opened to pressurize the tank 4. The abrasive blaster also includes a valve assembly 3 and 10 connected to a deadman valve 1. When the deadman valve is opened, pressurized air flows through the valve assembly for pressurizing the blast line 19 for propelling media from the tank 4, as mixed with the air in the blast line, through the nozzle 21. A blowdown valve 15 is provided for relieving the pressure in the tank 4 when the system is in the off or blowdown condition.

A closure assembly 5 is mounted on the top of the tank and includes a cam locking assembly 14 and a closure safety interlock 30 in accordance with the subject invention. A pressure check indicator valve 23 is typically provided in the tank near the closure assembly 5.

Figure 2:
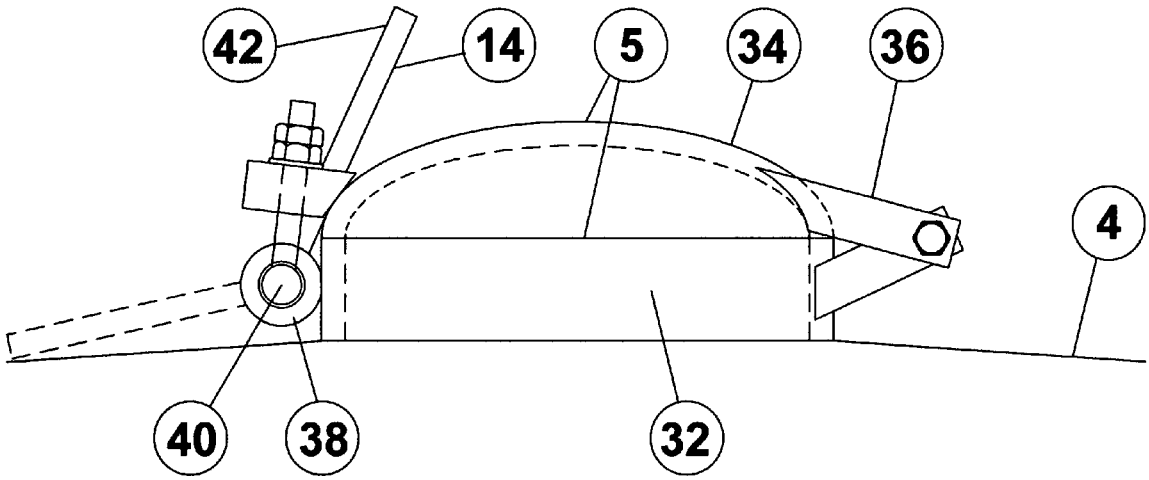
FIG. 2 is a side view of the closure assembly hub, head and swing lock assembly with the closure safety interlock of the subject invention removed for clarity.
Figure 3:
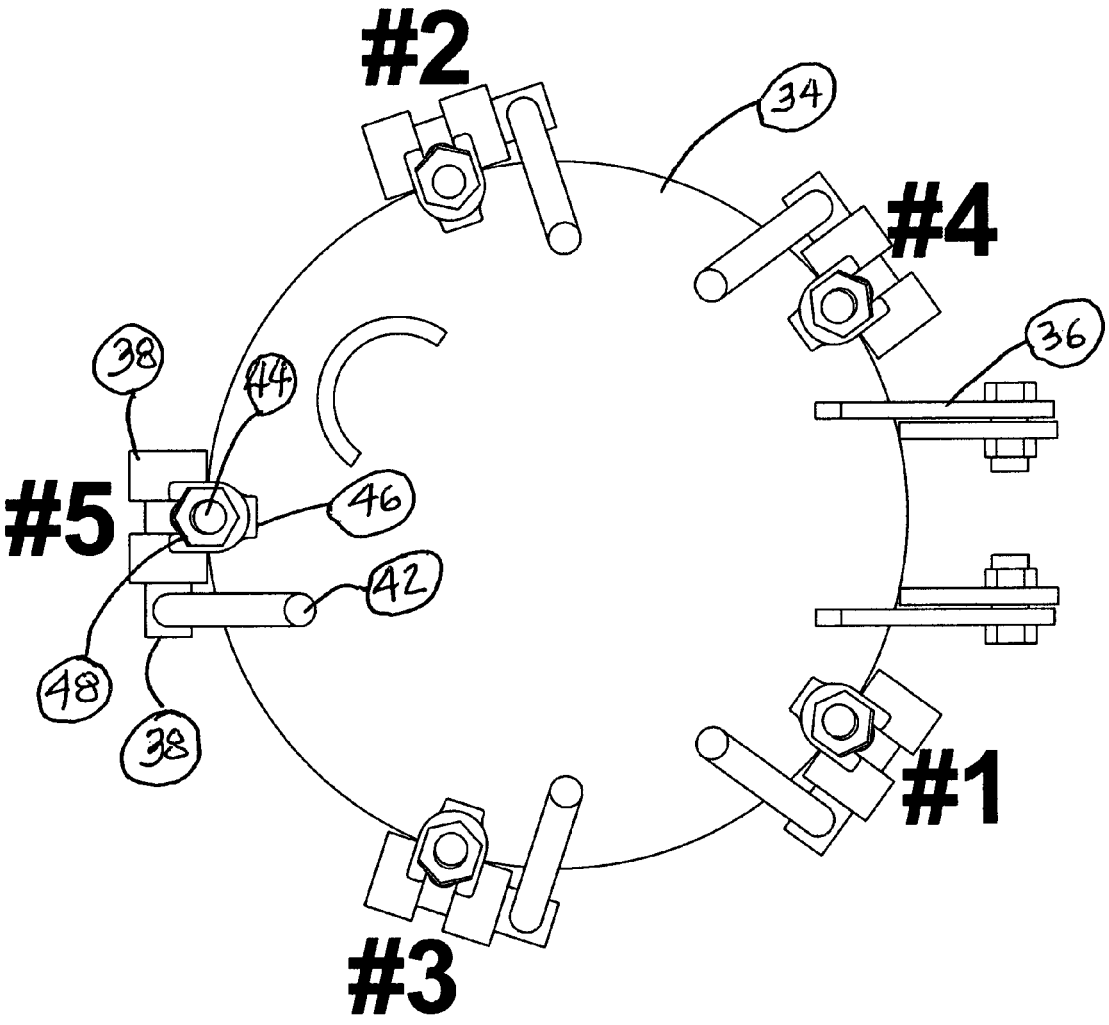
FIG. 3 is a top view of the closure assembly with the closure safety interlock of the subject invention removed.

As better shown in FIGS. 2 and 3, the typical closure assembly 5 includes a hub 32 which is mounted on the top of the tank 4, typically by welding. A closure head 34 is designed to be seated in the hub 32 and is hingedly mounted as shown at 36 to swing into and out of the closed seated position. A plurality of swing bolt cam lock assemblies 14 are provided for locking the head 34 in the locked, closed position relative to the hub 32.

Each swing bolt cam lock assembly includes one or more mounting brackets 38 (also see FIG. 4) for accepting the cammed end 40 of the camlock handle 42. A swing bolt 44 is mounted on each cam lock handle between the brackets 38. The swing bolt is adapted to swing into and out of the complementary holding lug 46 on the closure head 34. The swing nut is tightened against the head 34 by the lock nuts 48. When the camlock handle 42 is rotated to the upper position shown in FIG. 4, the cammed surface on end 40 tensions the bolt 44 for locking the head 34 in closed position. When the camlock handle is moved to the open (phantom) position of FIG. 2, the bolt tension is released and the bolts 44 may be moved out of the holding lugs 46, permitting the head 34 to be swung open on hinge assembly 36.

Figure 4:
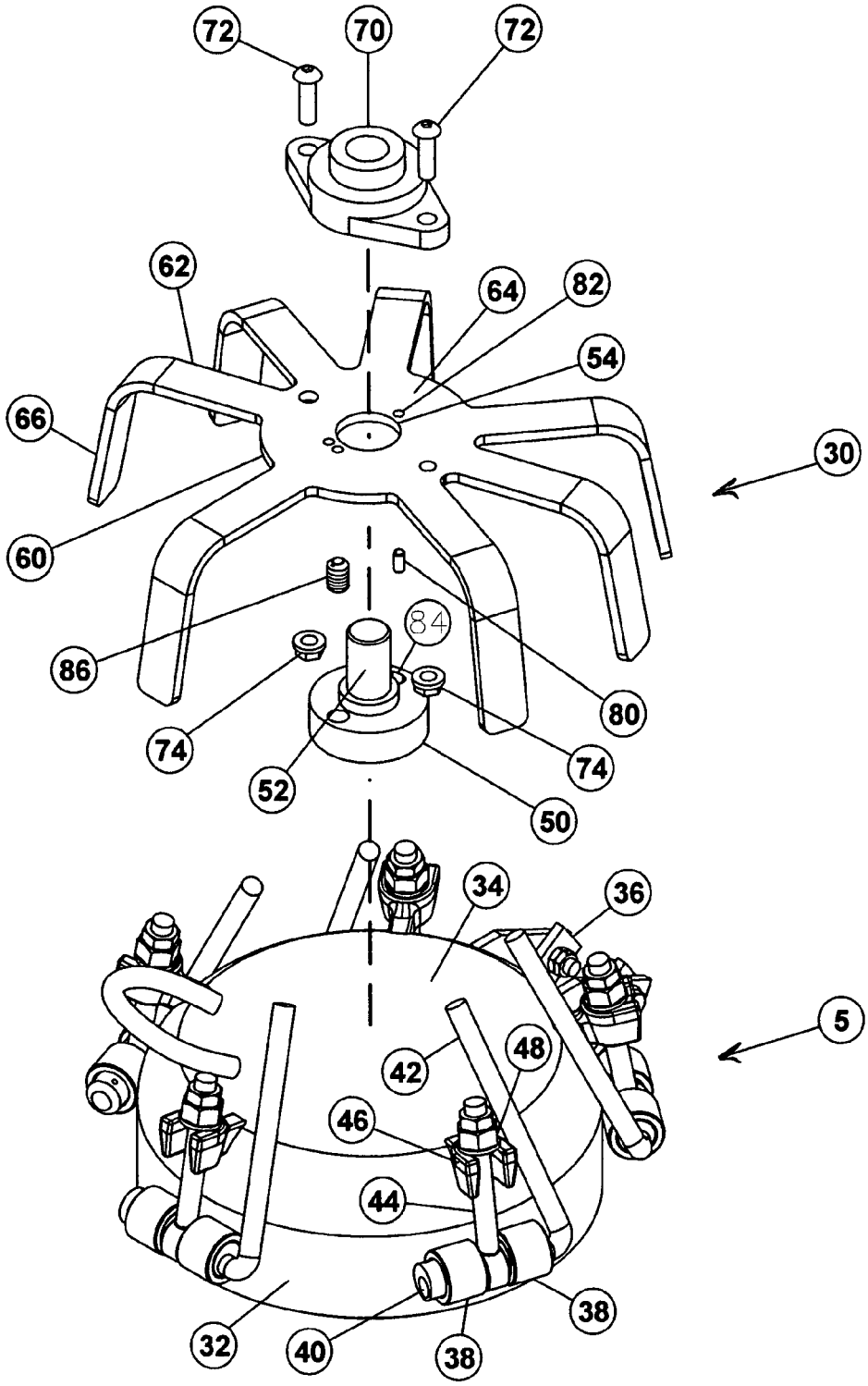
FIG. 4 is an exploded view of the closure safety interlock system of the subject invention.

An exploded view of the safety closure interlock 30 and the closure assembly 5 is shown in FIG. 4. The safety closure interlock 30 includes a mounting hub 50 which is mounted on the closure head 34. The hub may be mounted on the head by any suitable means, as will be readily understood by those who are skilled in the art. The hub 50 has a mounting post 52 for receiving the mounting hole 54 provided in the interlock shield 60. The interlock shield 60 includes a plurality of spokes or arms 62 extending radially outward from the shield hub 64 and terminating in a downwardly extending tab 66. The shield 60 is mounted on the hub 50 and secured for rotation relative thereto by the mount bearing 70. Typically, the shield 60 is secured to the mount bearing 70 by a plurality of mounting screws 72 and mounting nuts 74.

In the preferred embodiment, a rotation limiting pin 80 is mounted in the receptive hole 82 provided in the shield hub 64. This pin rides in the slot 84 provided in the mounting hub 50 and limits rotation of the shield assembly, assuring proper alignment of the shield with the swing bolt camlock handle system of the closure assembly. Also in the preferred embodiment a compression spring plunger 86 is provided to bias the shield assembly rotation between the locked position and the open position.

Figure 5:
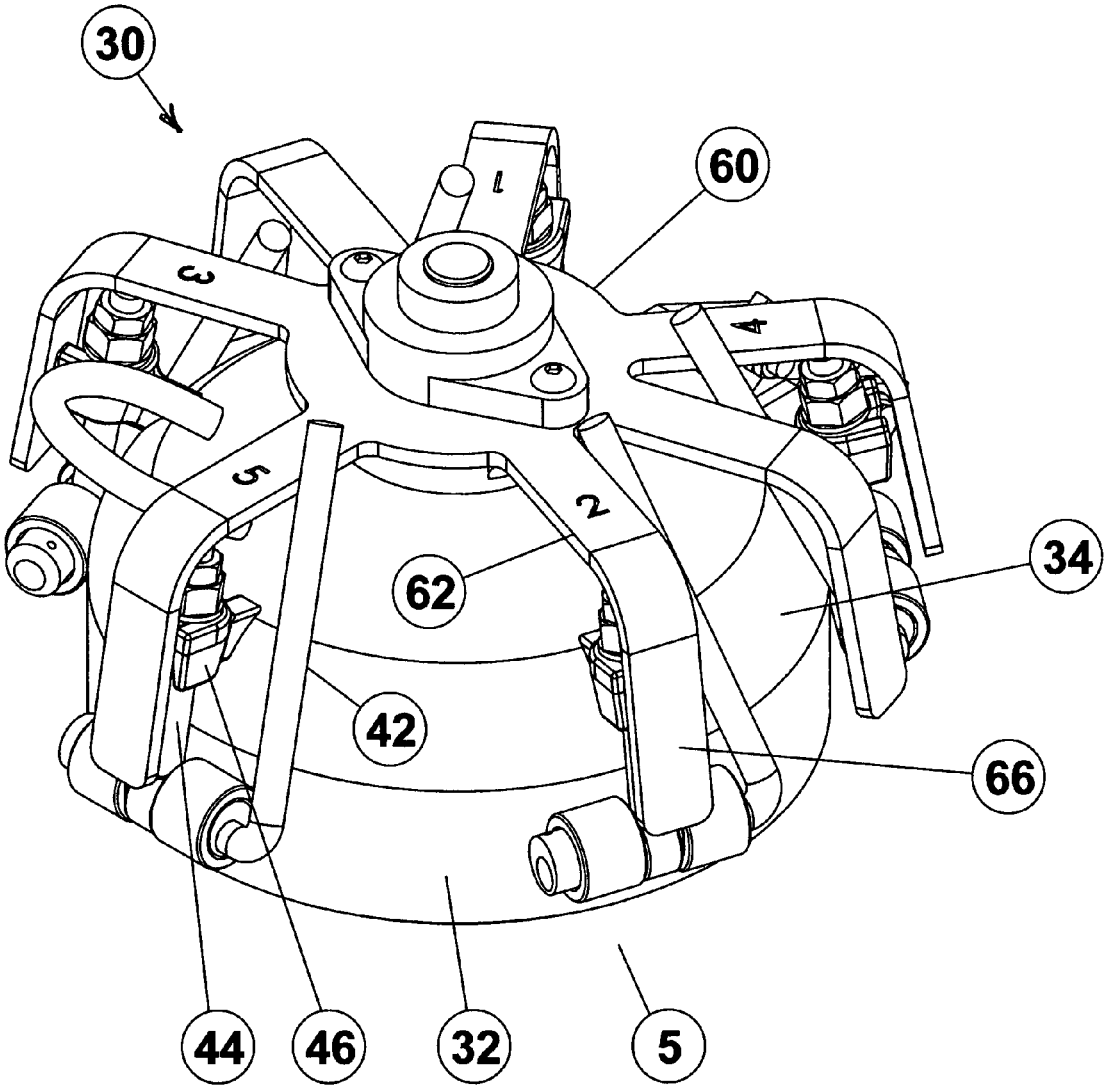
FIG. 5 is a view of the closure safety interlock system as installed on the closure assembly of FIG. 2.

The closure interlock safety system 30 of the present invention is shown in the assembled, locked position on the closure assembly 5 in FIG. 5. In this position the locking arms 62 and tabs 66 cover the complementary swing bolts 44 and lugs 46, making it difficult to use any tool to force the bolts out of the locking lugs. The cam lock handles are in the upper, locked position and prevent rotation of the shield assembly 30.

Figure 6:
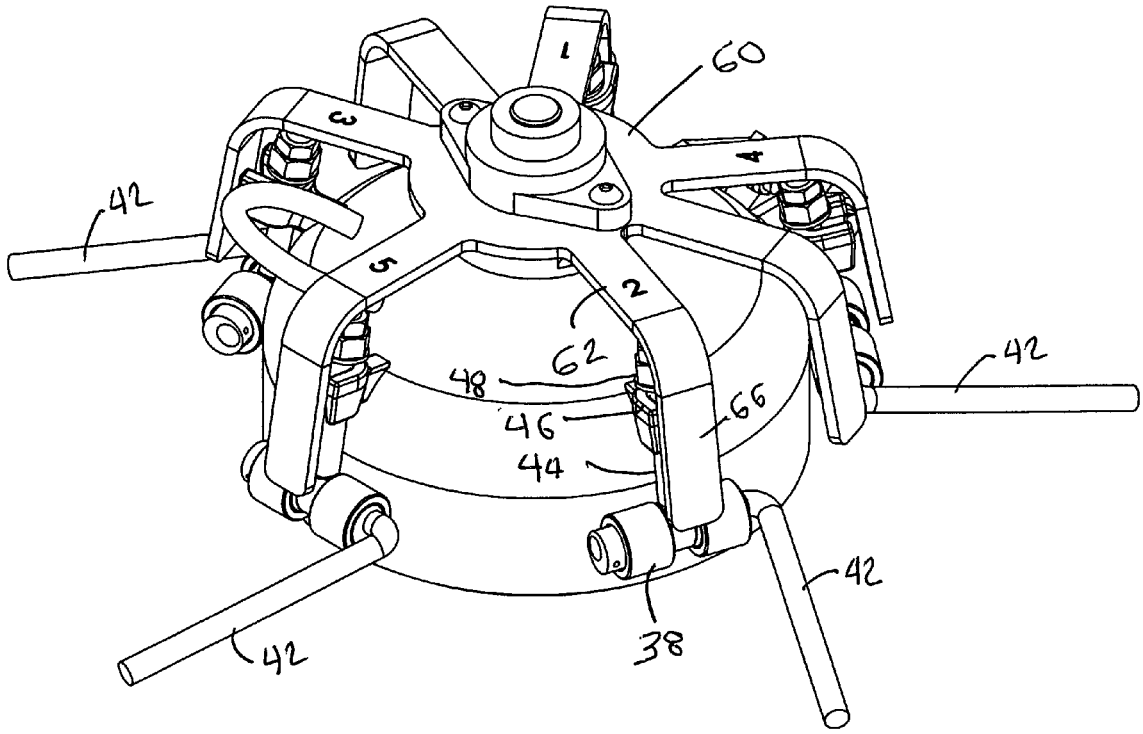
FIGS. 6, 7 and 8 illustrate the proper opening procedure.
Figure 7:
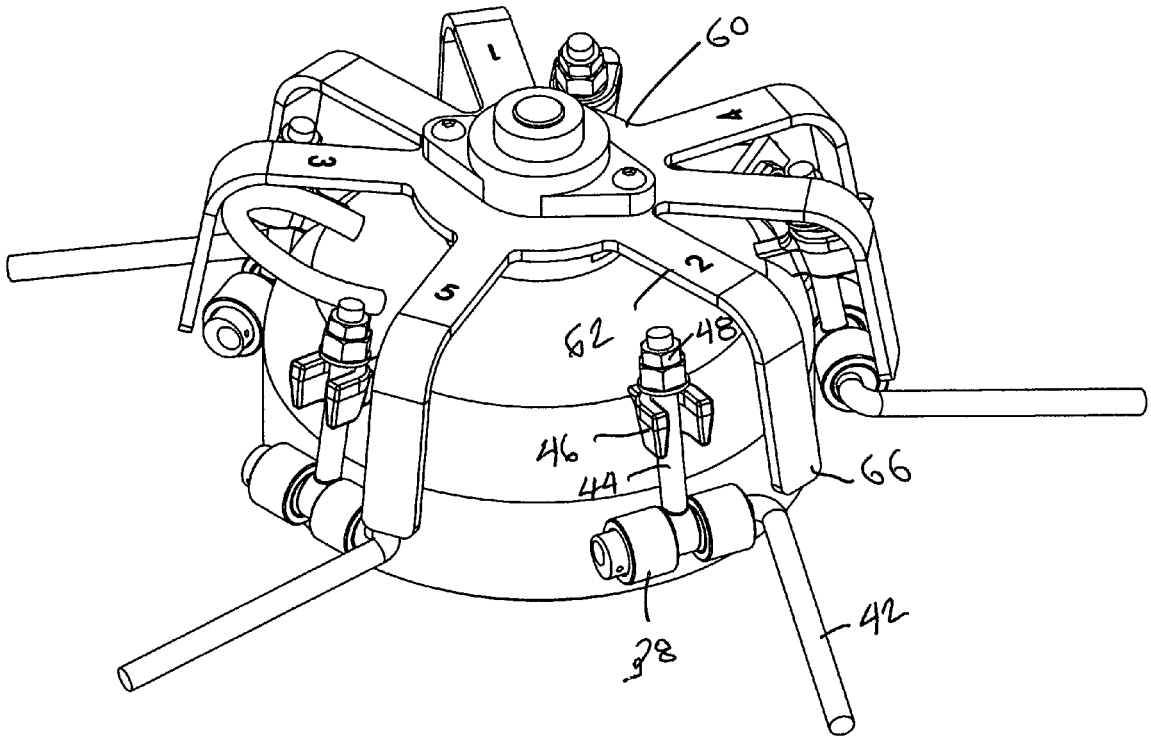
Figure 8:
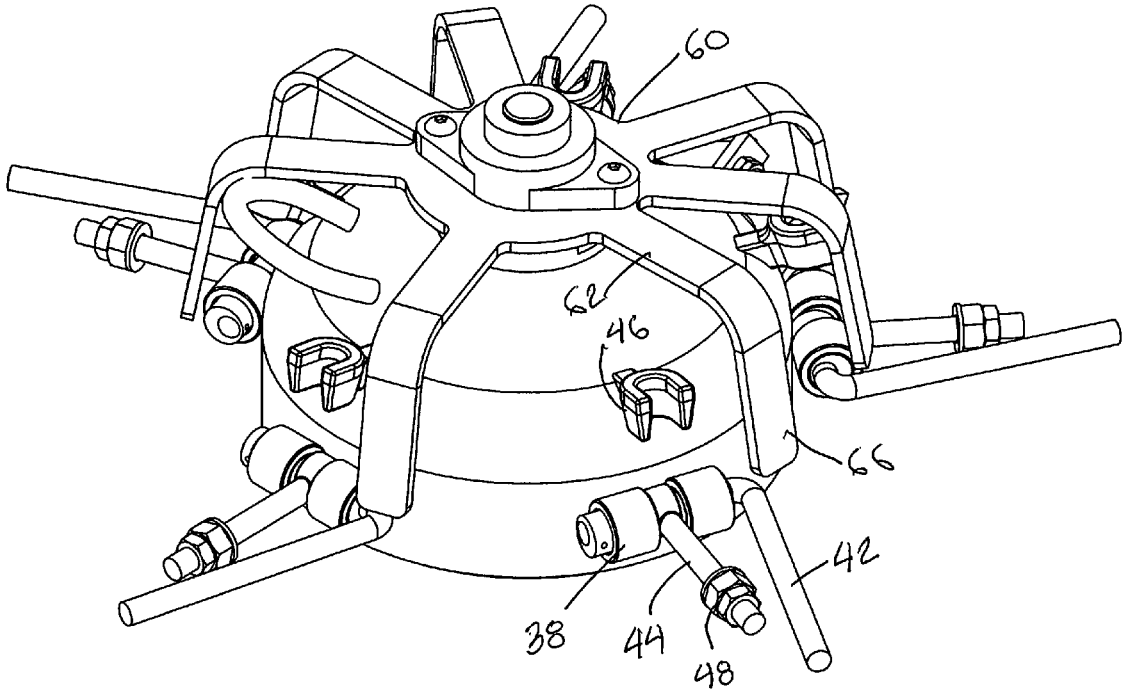

As shown in FIGS. 6, 7 and 8, during a proper opening sequence, the cam lock handles 42 are first moved from the closed position to the open position, releasing the tension on the bolts 44. The proper opening sequence is provided by the numbered indicia on the spokes 62 of the shield.

Once all of the cam lock handles are swung down to the open position as shown in FIG. 6, the interlock shield 30 may be rotated to expose the swing bolts 44 and lugs 46, as shown in FIG. 7. The bolts 44 are then swung out of the lugs 46 as shown in FIG. 8 and the closure head 34 may be opened.

While certain features and embodiments of the invention have been disclosed in detail herein, it will be readily understood that the invention includes all modifications and enhancements within the scope and spirit of the following claims.

The invention claimed is:

1. A closure assembly for a pressure vessel that have first and second members, the second member pivotally moved between an open and a closed position with respect to the first member; the assembly comprising:

a primary locking assembly mounted to the first member, the primary locking assembly comprises a plurality of mounting bracket, each mounting a cam handle having a swinging bolt with a locking member;

a secondary locking assembly mounted to the second member, the secondary locking assembly comprising a plurality of holding member that receives a respective locking member to lock and secure the second member to the first member;

a closure safety interlock assembly mounted over the second member, the closure safety interlock assembly comprising a rotational hub having a plurality of blocking members, each blocking member having a tab end, and a mounting assembly to mount the hub to the second member, each blocking member having a visible indicia;

wherein, when the second member is moved to contact the first member, each locking bolt is pivoted to interlock with a respective holding member and the hub is rotated so that each tab end overlap a respective holding member/locking member connection;

wherein, to move the second member away from the first member, the hub is rotated so as to move away from the holding member/locking member connection and the indicia will indicate the sequence that should be follow to move each locking member out of engagement from their respective holding member.

2. The safety interlock of claim 1, including a limiter device for limiting the movement of the blocking member from the engaged position to the disengaged position.

* * * * *